US009777989B2

(12) United States Patent
Lehmann et al.

(10) Patent No.: US 9,777,989 B2
(45) Date of Patent: Oct. 3, 2017

(54) LAUNCH SYSTEM FOR A GUIDED MISSILE AND A GUIDED MISSILE FOR SUCH A LAUNCH SYSTEM

(71) Applicant: MBDA Deutschland GmbH, Schrobenhausen (DE)

(72) Inventors: Stefan Lehmann, Petershausen (DE); Jörg Lutzenberger, Augsburg (DE)

(73) Assignee: MBDA Deutschland GmbH, Schrobenhausen (DE)

( * ) Notice: Subject to any disclaimer, the term of this patent is extended or adjusted under 35 U.S.C. 154(b) by 0 days.

(21) Appl. No.: 15/152,261

(22) Filed: May 11, 2016

(65) Prior Publication Data

US 2016/0377375 A1 Dec. 29, 2016

(30) Foreign Application Priority Data

May 12, 2015 (DE) ..... 10 2015 005 954
Jul. 28, 2015 (DE) ..... 10 2015 009 823

(51) Int. Cl.

| | |
|---|---|
| ***F41F 3/045*** | (2006.01) |
| ***F41A 19/06*** | (2006.01) |
| ***F41A 19/13*** | (2006.01) |
| ***F42B 15/00*** | (2006.01) |

(52) U.S. Cl.

CPC ..... *F41F 3/0455* (2013.01); *F41A 19/06* (2013.01); *F41A 19/13* (2013.01); *F42B 15/00* (2013.01); *F41F 3/045* (2013.01)

(58) Field of Classification Search

CPC ..... F41F 1/00; F41F 3/04; F41F 3/052; F41F 3/0455; F41F 3/042; F41A 19/58; F41A 19/57

USPC ..... 89/1.8, 1.806, 1.807, 1.813, 1.706; 102/205, 380, 376

See application file for complete search history.

(56) References Cited

U.S. PATENT DOCUMENTS

| | | | | |
|---|---|---|---|---|
| 1,108,717 A * | 8/1914 | Davis | F42B 5/02 | 102/430 |
| 1,311,021 A * | 7/1919 | Spear | F41A 1/10 | 102/282 |
| 2,504,160 A * | 4/1950 | Skinner | F41A 19/52 | 89/1.813 |
| 3,027,839 A * | 4/1962 | Grandy | C06C 5/06 | 102/275.1 |

(Continued)

FOREIGN PATENT DOCUMENTS

| | | |
|---|---|---|
| DE | 1107561 B | 5/1961 |
| DE | 2224847 A | 11/1973 |

(Continued)

OTHER PUBLICATIONS

German Patent Office, German Office Action for German Patent Application No. 10 2015 009 823.3 dated Oct. 5, 2015.

(Continued)

*Primary Examiner* — Derrick Morgan
(74) *Attorney, Agent, or Firm* — Lorenz & Kopf, LLP

(57) ABSTRACT

The present embodiment relates to a guided missile launch system comprising a launch tube with a guided missile space for receiving a guided missile and with a cartridge space for receiving a blank cartridge, further comprising a handle piece mountable on the launch tube and separable from the launch tube, the handle piece having a striking pin system for firing the blank cartridge.

13 Claims, 3 Drawing Sheets

(56) References Cited

U.S. PATENT DOCUMENTS 3,059,542 A * 10/1962 Manz ..... F41A 19/69 280/836
3,059,543 A * 10/1962 Manz ..... F41A 19/69 89/1.807
3,097,564 A * 7/1963 Stevenson ..... F41A 19/57 89/1.704
3,099,937 A * 8/1963 Bartels ..... F41A 3/74 89/24
3,122,059 A * 2/1964 Choate ..... F41F 3/04 42/106
3,128,670 A * 4/1964 Blacker ..... A21C 3/00 102/437
3,204,530 A * 9/1965 McGowan ..... F41A 3/38 89/1.801
3,216,323 A * 11/1965 Wengenroth ..... F41A 1/08 102/437
3,371,578 A * 3/1968 Choate ..... F41A 33/00 42/77
3,421,410 A * 1/1969 Kayaian ..... F41A 19/59 89/1.807
3,489,058 A * 1/1970 Andersson ..... F41A 1/08 102/444
3,677,131 A * 7/1972 Nee ..... F41F 3/0455 102/520
3,982,467 A * 9/1976 Smith ..... F42B 30/04 102/380
4,128,039 A * 12/1978 Skliris ..... F41A 9/27 89/1.803
4,416,183 A * 11/1983 Adams ..... F41F 3/052 89/1.807
4,417,498 A * 11/1983 Dissmeyer ..... F41A 19/58 89/1.814
4,531,445 A * 7/1985 Nee ..... F41F 3/0455 89/1.813
4,586,420 A * 5/1986 Toutin ..... F41A 19/57 102/275.11
4,593,602 A * 6/1986 Faix ..... F41A 19/27 102/349
5,125,319 A * 6/1992 Goricke ..... F41F 3/052 89/1.806
5,390,581 A * 2/1995 Hiltz ..... F41F 3/052 102/347
5,854,440 A * 12/1998 Canaday ..... F41A 15/12 42/69.03
6,138,944 A * 10/2000 McCowan ..... F41G 7/26 244/3.1
7,418,896 B1 * 9/2008 Dindl ..... F41A 1/10 102/437
8,220,376 B2 * 7/2012 Jonsson ..... F41A 1/10 89/1.701
2001/0039897 A1 * 11/2001 Renaud-Bezot ..... F41F 3/0455 102/476
2004/0069174 A1 * 4/2004 Dorn ..... F42B 5/05 102/437
2007/0056461 A1 * 3/2007 Konicke ..... F41A 9/375 102/431
2013/0152773 A1 * 6/2013 Yeh ..... F41A 17/56 89/1.813

FOREIGN PATENT DOCUMENTS

| | | | |
|---|---|---|---|
| DE | 2446177 | A1 | 4/1976 |
| DE | 3130963 | A1 | 3/1983 |
| DE | 3841568 | A1 | 6/1990 |
| EP | 0022430 | B1 | 12/1983 |
| EP | 0372431 | A1 | 6/1990 |
| FR | 1206603 | A | 2/1960 |
| WO | 8605869 | A1 | 10/1986 |

OTHER PUBLICATIONS

European Patent Office, Extended European Search Report in Application No. 16169297.5-1655 dated Sep. 14, 2016.

* cited by examiner

LAUNCH SYSTEM FOR A GUIDED MISSILE AND A GUIDED MISSILE FOR SUCH A LAUNCH SYSTEM

CROSS REFERENCE TO RELATED APPLICATIONS

This application claims priority of German Patent Applications Numbers 10 2015 005 954.8 filed 12 May 2015, and 10 2015 009 823.3 filed 28 Jul. 2015, which is incorporated herein by reference in its entirety.

TECHNICAL FIELD

The embodiments described herein relate to a guided missile launch system. Furthermore, the embodiments relate to a guided missile for use in such a guided missile launch system. In particular, the guided missile launch system is shoulder-launched and consequently designed as portable by a single user.

In the state of the art, launch tubes for guided missiles are known which a user may employ shoulder-launched. In the case there is danger that an accidental firing occurs or an interlock of the guided missile inside the launch tube is accidentally released. In both cases an undesired exit of the guided missile from the launch tube occurs, which presents a high danger at least for the user. In addition there are increased efforts for such launch systems with respect to storage and transport.

Therefore, it is an object of the embodiment to provide a guided missile launch system which enables secure operation of the guided missile and a simple and cost-effective manufacture and assembly.

Thus, the object is achieved by a guided missile launch system comprising a launch tube and a handle piece. The launch tube has a guided missile space which is designed for receiving a guided missile. In addition, the launch tube has a cartridge chamber which is designed for receiving a blank cartridge. In particular, it is the guided missile space as well as the cartridge space has a connection to an environment of the launch tube. In particular, the design is such that the guided missile space and the cartridge space are completely separate from each other. Consequently, a firing of the blank cartridge does not result in a firing of the guided missile. The handle piece may be mounted to the launch tube, whereby the handle piece may be separated from the launch tube at any time. The handle piece has a striking pin system for firing the blank cartridge. Therefore, the guided missile launch system exhibits increased safety with respect of the operation. If the launch tube is separated from the handle piece, an accidental firing of the blank cartridge is not possible since the associated striking pin system is provided in the separate handle piece.

The launch tube advantageously comprises an opening in which a striking pin element is arranged. Thereby the striking pin element protrudes into the guided missile space. Consequently, the opening of the launch tube connects the guided missile space with the surroundings of the launch tube. By inserting the striking pin element, the opening is advantageously entirely closed. The engagement of the striking pin element into the guided missile space enables that the striking pin element may engage a firing port of the guided missile. Since the striking pin element thus engages into the opening of the launch tube as well as into the firing port of the guided missile, an axial centering of the opening of the launch tube and the firing port of the guided missile is achieved. Thus, the guided missile has a predetermined alignment within the launch tube.

A particular advantage is achieved if the striking pin element comprises a collar through which the striking pin element is fixed within the launch tube. In particular, it is thus prevented that the striking pin element is entirely guided through the opening of the launch tube. Thus, preventing the danger of an accidental firing of the guided missile.

In addition, a particular advantage is achieved if the collar is designed as a tear-off element. If a sufficiently high force acts upon the striking pin element, then the collar may fail, resulting in the striking pin element being entirely transferred from the opening of the launch tube into the firing port of the guided missile. Within the firing port of the guided missile, the striking pin element may then initiate a firing of the guided missile.

An advantage is achieved if the guided missile in the launch tube is interlocked with the striking pin element. Thus, an interlock is provided by the striking pin element. This interlock cannot be accidentally released, but can merely be released by a full displacement of the striking pin element into the firing port of the guided missile. Thus, the interlock is released by the striking pin element only when the guided missile is to be fired. An accidental release is thus prevented.

An advantage is achieved if the handle piece comprises a gas channel. The blank cartridge space is connected with the striking pin element if the handle piece is mounted to the launch tube. If in the case in which the handle piece is mounted to the launch tube, the blank cartridge would be fired, then a gas pressure will be built up within the gas channel, which gas pressure exerts a resulting force on the striking pin element. In this case it is advantageously provided that a displacement of the striking pin element into the firing port of the guided missile occurs so that the striking pin element fires the guided missile. Since the gas channel is arranged within the handle piece, a firing of the blank cartridge when the handle piece is not mounted on the launch tube does not result in a displacement of the striking pin element since the gas channel is not present. In that case, only the gas pressure from the blank cartridge would be released into the surroundings of the guided missile launch system. In this manner, the operational safety and the safety during the handling of the guided missile launch system are distinctly enhanced.

As an alternative the guided missile launch system comprises an accessory element. A gas channel is provided in the accessory element. The blank cartridge space is connected with the striking pin element via the gas channel if the handle piece is mounted on the launch tube and the accessory element is inserted into the handle piece or into the launch tube. A particular advantage is achieved if the accessory element is movingly attached to the handle piece and may in particular swing out from the handle piece or may swing into the handle piece. In this manner, the operational safety and the safety during the handling of the guided missile launch system are further enhanced, since when the accessory is missing, a handle piece mounted to the launch tube cannot result in a firing of the blank cartridge.

Thus, the operational safety is enhanced in two stages. Should the handle piece be separated from the launch tube, then a firing of the blank cartridge is not possible due to the missing striking pin system. If nevertheless the blank cartridge is fired due to negligence, then there is no connection to the guided missile space, such that the firing of the blank cartridge has no effect on the guided missile itself. Only if the handle piece and the launch tube are connected is a firing of the blank cartridge possible.

It is preferred that the launch tube comprises an additional interlock element. With the additional interlock element, the guided missile may be interlocked in the launch tube of the guided missile launch system. Thus, an additional manual interlock is present, resulting in the guided missile being safely and reliably supported within the guided missile space.

It is an advantage if the blank cartridge is fixedly integrated into the cartridge space. In this manner, the blank cartridge cannot be removed by a user. Thus, it is guaranteed that the blank cartridge is at hand at all times, such that a missing fitness for operational use due to a missing blank cartridge is excluded. In addition, an accidental firing of the blank cartridge within the launch tube is impeded, such there is no danger that the blank cartridge may be accidentally fired.

The embodiments also relate to a guided missile for use in a guided missile launch system as described before. Here the guided missile comprises a firing port. A striking pin element of the guided missile launch system is designed such that it may be inserted into the firing port. In this manner, the guided missile can be fixed in a launch tube of the guided missile launch system. Therefore, the striking pin element advantageously has the task of holding the guided missile within the launch tube of the guided missile launch system in a predetermined orientation and to simultaneously interlocking it. The interlock is only then releasable when the striking pin element is fully inserted into the firing port, whereby the guided missile is fired.

According to a preferred embodiment, the firing port leads to a thermal battery of the guided missile. It is a particular advantage if the firing port leads to a detonator of the thermal battery. In this manner, it is made possible that the striking pin element strikes on the detonator of the thermal battery, resulting in supplying energy to the guided missile. This results in launching the guided missile out of the guided missile launch system.

BRIEF DESCRIPTION OF THE DRAWINGS

The various embodiments will hereinafter be described in conjunction with the following drawing figures, wherein like numerals denote like elements, and.

DETAILED DESCRIPTION

The following detailed description is merely exemplary in nature and is not intended to limit the disclosed embodiments or the application and uses thereof. Furthermore, there is no intention to be bound by any theory presented in the preceding background detailed description.

Figure 1:
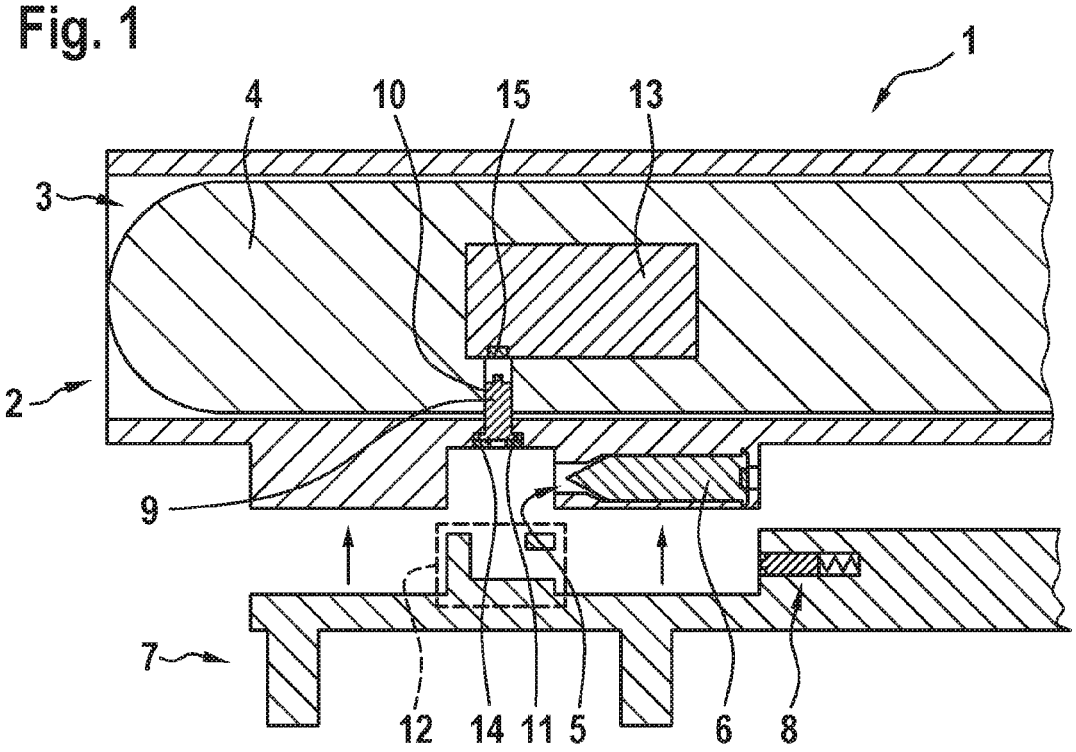
FIG. 1 is a schematic representation of a guided missile launch system according to an embodiment with separate launch tube and handle piece.
Figure 2:
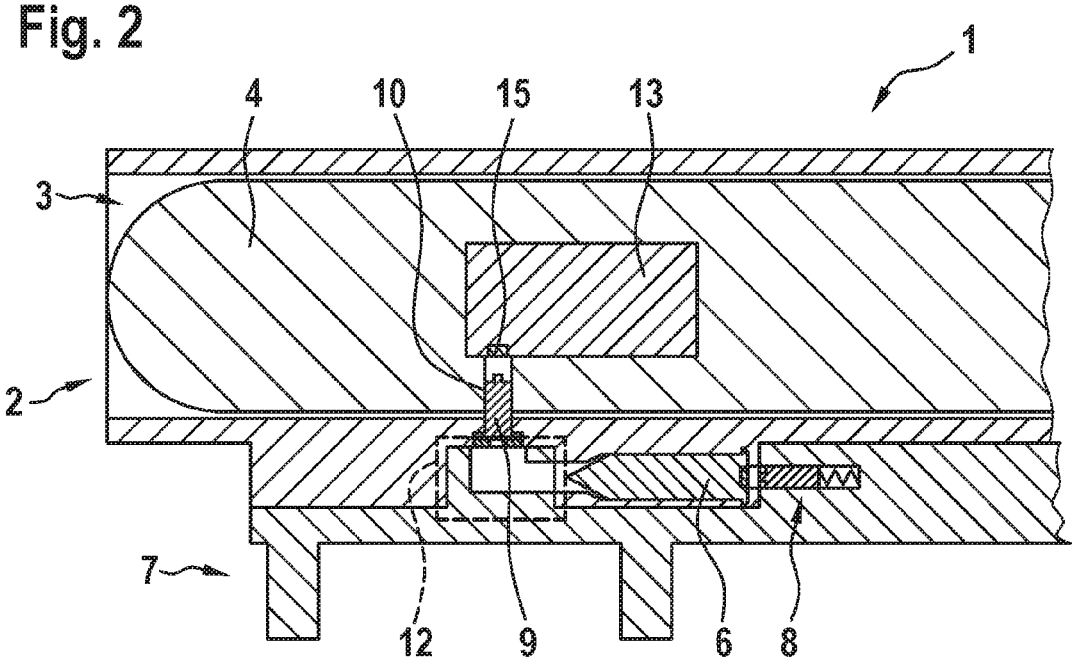
FIG. 2 is a schematic representation of the guided missile launch system according to the embodiment with mounted handle piece and launch tube.

FIG. 1 is a schematic view of a guided missile launch system according to an embodiment. The guided missile launch system comprises a launch tube 2 and a handle piece 7. In FIG. 1 the handle piece 7 is separated from the launch tube 2. FIG. 2 shows the guided missile launch system of FIG. 1, wherein the handle piece 7 is mounted on the launch tube 2.

The guided missile launch system 1 is particularly suitable for launching shoulder-launched guided missiles 4. Thereby the launch tube 2 serves as a logistic packaging for the guided missile and also for launching the guided missile 4.

The handle piece 7 is in particular only connected with the launch tube 2 for the purpose of launching the guided missile 4, and serves for operating the guided missile launch system, for safeguarding the guided missile 4, and for initiating the firing process. The guided missile 4 is supported in the launch tube 2 and is interlocked and safeguarded by two independent interlock mechanisms. A first interlock mechanism is provided in a manner that the guided missile 4 is manually interlocked with the launch tube. This is known in the art and therefore not shown in the Figures. A second interlock mechanism consists of a striking pin element 9 which is arranged within an opening of the launch tube 2 as well as within a firing port of the guided missile 4. Thereby the firing port 10 serves as an interface of the guided missile for initiating and thereby launching the guided missile 4.

Initiating the guided missile 4 is conducted by the purposeful impingement of a detonator 14 arranged in a thermal battery 13 of the guided missile by the striking pin element 9. To that end, the striking pin element 9 has to be accelerated for impinging on the detonator 15. This is initiated by a blank cartridge 6.

The blank cartridge 6 is arranged within a cartridge space 5 of the launch tube 2. The cartridge space 5 is separated from the guided missile space 3. The cartridge space 5 comprises an opening such that the cartridge space 5 is open towards the surroundings of the launch tube 2. The blank cartridge 6 is advantageously fixedly arranged within the cartridge space 5 such that removal of the blank cartridge 6 by a user of the guided missile launch system is not possible.

Only by inserting the handle piece 7 into the launch tube 2 is the cartridge space 5 connected with the striking pin element 9. To that end, the handle piece 7 comprises a gas channel 12. The gas channel 12 connects the cartridge space 5 with the guided missile space 3 only when the handle piece is mounted to the launch tube 2. If the handle piece 7 is mounted to the launch tube 2, then the blank cartridge 6 may be fired for generating an overpressure within the gas channel 12. This overpressure within the gas channel 12 resulting in an acceleration of the striking pin element 9.

For initiating the blank cartridge 6, a conventional striking pin system 8 is provided. Such a striking pin 8 may, for example, also be built into hand guns. The striking pin element is fully integrated within the handle piece 7 such that the striking pin element 8 can be separated from the launch tube 2 together with the handle piece 7. In this manner the product safety is considerably enhanced since an accidental firing of the blank cartridge is prevented. Only by mounting the handle piece 7 on the launch tube 2 is the striking pin system 8 is axially aligned to the blank cartridge 6 for enabling a firing of the blank cartridge 6. Simultaneously, by inserting the handle piece 7, the gas channel 12 in between cartridge space 5 and striking pin element 9 is established, such that a firing of the blank cartridge 6 results in an acceleration of the striking pin element 9.

Figure 3:
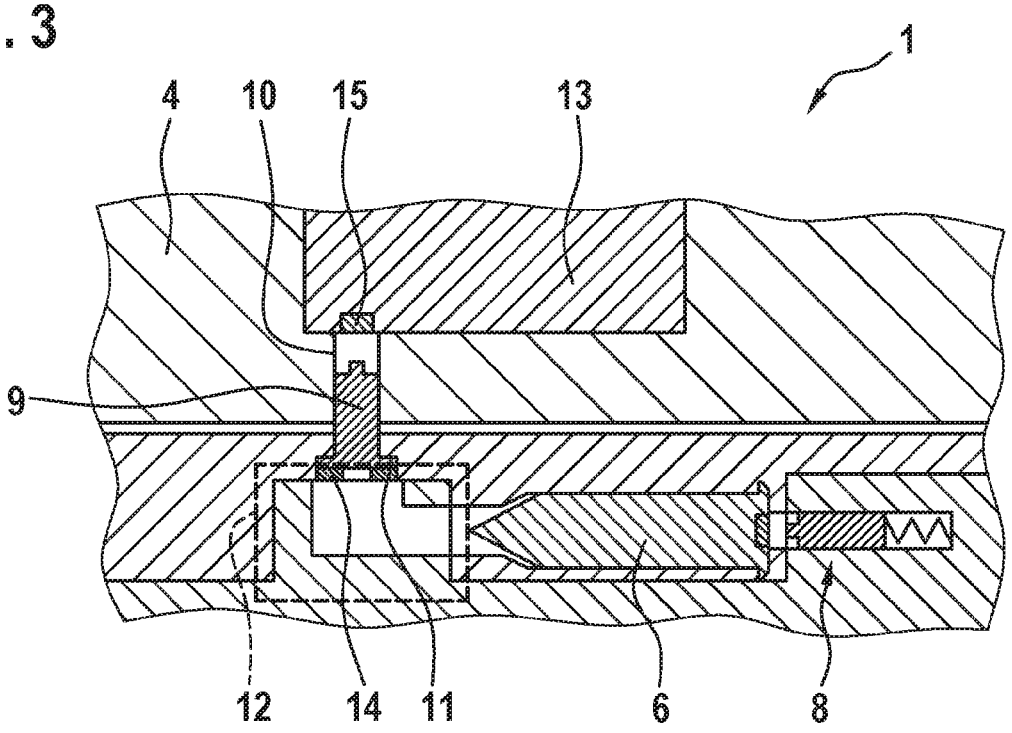
FIG. 3 is a schematic representation of a detail of the guided missile launch system according to the embodiment.

FIG. 3 shows a detailed view of the guided missile launch system 1. In FIG. 3 the guided missile launch system 1 is depicted in such a manner that the handle piece 7 is mounted on the launch tube 2.

It is evident that the striking pin element 9 engages the firing port 10 of the guided missile 4. This firing port 10 is axially aligned with an opening within the launch tube 2 such that the striking pin element is inserted into the opening of the launch tube 2 as well as into the firing port 10 of the guided missile in alignment.

For preventing the striking pin element from being inadvertently displaced from its position, the striking pin element 9 comprises a collar 11 which abuts the launch tube 2 outside the guided missile space 3. The collar 11 is fixed via a locking ring 14. In this manner a movement of the striking pin element 9 is prevented. Therefore, the striking pin element 9 serves as an interlock for the guided missile 4, since the at least partial engagement of the striking pin element 9 in the firing port 10 prevents a displacement of the guided missile 4 within the guided missile space 3 of the launch tube 2. This interlock may only be released by firing the blank cartridge 6, since this firing results in a displacement of the striking pin element 9, whereby the striking pin element 9 is entirely arranged within the firing port 10.

The collar 11 is designed as a tear-off element. If by firing of the blank cartridge 6 the gas pressure within the gas channel 12 increases, this results in that the collar is torn off, such that the striking pin element 9 is rendered displaceable. Due to the pressure within the gas channel 12, an acceleration of the striking pin element 9 into the firing port 10 of the guided missile 4 occurs. This case is depicted in FIG. 4.

Figure 4:
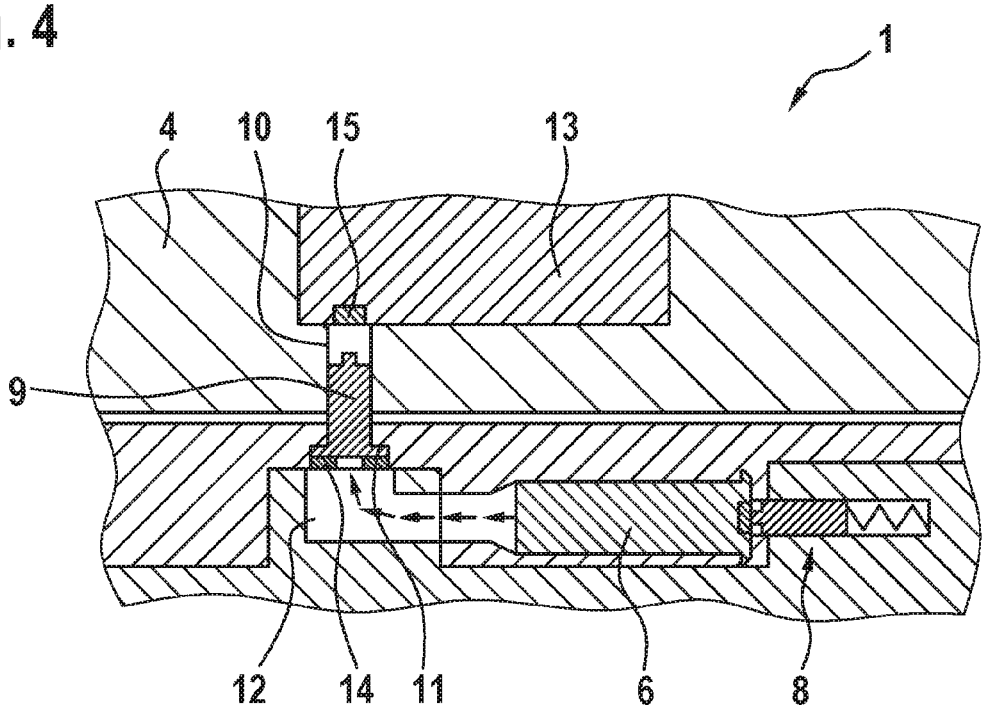
FIG. 4 is a first detailed schematic representation of the guided missile launch system according to the embodiment during a process of firing the guided missile.

In FIG. 4, the striking pin system 8 was triggered such that the blank cartridge 6 was fired. This happens in an analogous manner to the firing of a hand gun. By firing the blank cartridge 6, an overpressure within the gas channel 12 is generated. This overpressure acts on the striking pin element 9. As soon as the overpressure reaches a predetermined pressure, the collar 11 of the striking pin element 9 fails. This case is depicted in FIG. 5.

Figure 5:
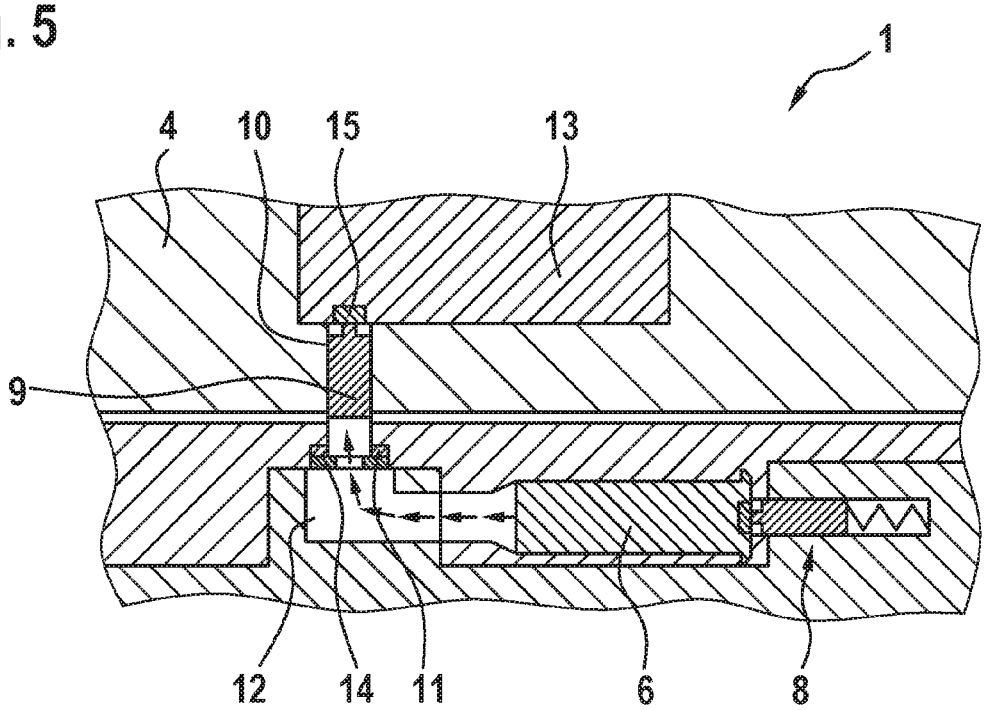
FIG. 5 is a second detailed schematic representation of the guided missile launch system according to the embodiment during a firing of the guided missile.

In FIG. 5, the collar 11 of the striking pin element 9 has failed such that the striking pin element 9 is accelerated by the gas pressure within the gas channel 12. Due to the acceleration of the striking pin element 9, it will be entirely inserted into the firing port of the guided missile 4. Therefore, on the one hand the interlock between launch tube 2 and guided missile 4 which was established by the striking pin element 9, is released, and on the other hand the striking pin element 9 impinges on the detonator 15 of the thermal battery 13 of the guided missile 4. In this manner the thermal battery 13 is activated whereby the guided missile 4 is supplied with electric energy. This leads to boosting the electronics of the guided missile whereby the functions of the guided missile are started. This results advantageously in a launch of the guided missile from the launch tube 2.

Furthermore, the embodiment has the following advantages: System initialization under use of a gas generator in the form of a blank cartridge, which due to its design is outstanding in respect of a fully integrated detonator chain and a high robustness to environmental factors.

Systemic separation of primary initiator and energy carrier or detonator chain, respectively, under simultaneous interruption of the gas channel due to a segmented design, wherein a gas channel segment remains in the handle piece and opens the gas channel in such a manner that in the separated configuration no confinement and therefore no gas pressure increase in the gas channel system is possible. This contributes substantially to making the system more robust and to maximizing product safety. In the present case the primary initiator is advantageously a firing pin kinematic in the handle piece, while the energy carrier or the detonator chain, respectively is formed by the blank cartridge.

Integration of a pin element with double functions which is built into the entire system under form-fit, and interlocks the guided missile axially as well as radially in the launch tube, and changes its function and form according to its second destination as a striking pin element, wherein then when a minimum gas pressure at the bottom of the striking pin element is reached, a geometrical offset or flange, in particular a collar, tears off from the striking pin element, such that the form-fit is released and the pin is accelerated for initiating in the direction of an internal detonator chain of the guided missile, such that during the acceleration also the interlock in the entire system is released.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the embodiment in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the embodiment as set forth in the appended claims and their legal equivalents.

What is claimed is:

1. A guided missile launch system comprising:

a launch tube having a guided missile space for receiving a guided missile and having a cartridge space for receiving a blank cartridge; and a handle piece mountable on the launch tube and separable from the launch tube, the handle piece having a striking pin system for firing the blank cartridge;

wherein the launch tube comprises an opening in which a striking pin element is arranged, wherein the striking pin element protrudes into the guided missile space to accommodate engagement with a firing port of the guided missile, wherein the striking pin element engages the firing port to interlock the guided missile in the launch tube; and wherein the handle piece comprises a gas channel which connects the cartridge space with the striking pin element when the handle piece is mounted on the launch tube.

2. The guided missile launch system of claim 1, wherein the striking pin element comprises a collar through which the striking pin element is fixable in the launch tube.

3. The guided missile launch system of claim 2, wherein the collar is a tear-off element.

4. The guided missile launch system of claim 1, wherein the launch tube comprises an interlock element by which the guided missile is interlockable in the guided missile space.

5. The guided missile launch system of claim 1, wherein a blank cartridge is fixedly provided such that the blank cartridge cannot be removed by a user.

6. A guided missile for use in a guided missile launch system, wherein the guided missile comprises:

a firing port configured to receive a striking pin element of the guided missile launch system;

wherein the firing port engages the striking pin element to fix the guided missile in a launch tube of the guided missile launch system when the striking pin element is received in the firing port;

wherein the firing port is configured such that the striking pin element is fully insertable into the firing port in order to fire the guided missile.

7. The guided missile of claim 6, wherein the firing port leads to a thermal battery of the guided missile to accommodate an impingement of the striking pin element on a detonator of the thermal battery.

8. The guided missile of claim 6, wherein the guided missile is configured to be interlocked by the striking pin element in a launch tube of a guided missile launch system.

9. A guided missile launch system comprising:

a launch tube having a guided missile space for receiving a guided missile and having a cartridge space for receiving a blank cartridge; and a handle piece mountable on the launch tube and separable from the launch tube, the handle piece having a striking pin system for firing the blank cartridge;

wherein the launch tube comprises an opening in which a striking pin element is arranged, wherein the striking pin element protrudes into the guided missile space to accommodate engagement with a firing port of the guided missile, wherein the striking pin element engages the firing port to interlock the guided missile in the launch tube; and the guided missile launch system further comprising an accessory element comprising a gas channel which connects the cartridge space with the striking pin element when the handle piece is mounted on the launch tube and the accessory element is inserted into the launch tube or the handle piece.

10. The guided missile launch system of claim 9, wherein the striking pin element comprises a collar through which the striking pin element is fixable in the launch tube.

11. The guided missile launch system of claim 10, wherein the collar is a tear-off element.

12. The guided missile launch system of claim 9, wherein the launch tube comprises an interlock element by which the guided missile is interlockable in the guided missile space.

13. The guided missile launch system of claim 9, wherein a blank cartridge is fixedly provided such that the blank cartridge cannot be removed by a user.

* * * * *